US009328535B2

(12) United States Patent
Baker et al.

(10) Patent No.: US 9,328,535 B2
(45) Date of Patent: May 3, 2016

(54) PADLOCK CYLINDER RETENTION

(71) Applicant: KWIKSET CORPORATION, Lake Forest, CA (US)

(72) Inventors: Scott Calvin Baker, Lake Forest, CA (US); Matthew Jacob Richman, Ladera Ranch, CA (US)

(73) Assignee: Kwikset Corporation, Lake Forest, CA (US)

( * ) Notice: Subject to any disclaimer, the term of this patent is extended or adjusted under 35 U.S.C. 154(b) by 0 days.

(21) Appl. No.: 14/586,331

(22) Filed: Dec. 30, 2014

(65) Prior Publication Data

US 2015/0204111 A1 Jul. 23, 2015

Related U.S. Application Data

(60) Provisional application No. 61/928,483, filed on Jan. 17, 2014.

(51) Int. Cl.

| | |
|---|---|
| ***E05B 67/22*** | (2006.01) |
| ***E05B 67/02*** | (2006.01) |
| ***E05B 67/06*** | (2006.01) |
| *E05B 67/24* | (2006.01) |

(52) U.S. Cl.

CPC ..... *E05B 67/22* (2013.01); *E05B 67/02* (2013.01); *E05B 67/06* (2013.01); *E05B 67/24* (2013.01)

(58) Field of Classification Search

CPC ..... E05B 67/00; E05B 67/02; E05B 67/06; E05B 67/063; E05B 67/22; E05B 67/24

See application file for complete search history.

(56) References Cited

U.S. PATENT DOCUMENTS

| | | | | |
|---|---|---|---|---|
| 1,246,472 | A | 11/1917 | Salvatore | |
| 3,422,643 | A * | 1/1969 | Foote | E05B 67/02 70/371 |
| 3,750,432 | A | 8/1973 | Errani et al. | |
| 4,099,397 | A | 7/1978 | Dauenbaugh | |
| 4,138,868 | A * | 2/1979 | Richards, Sr. | E05B 67/24 70/367 |
| 4,180,996 | A * | 1/1980 | Lebrecht | E05B 67/24 70/417 |
| 4,290,279 | A * | 9/1981 | Fish | E05B 67/24 70/367 |
| 4,419,873 | A * | 12/1983 | Sopko | E05B 67/38 70/38 A |
| 4,703,638 | A | 11/1987 | Bergstrom | |
| 4,811,578 | A * | 3/1989 | Masoncup | E05B 45/005 70/38 A |
| 5,174,136 | A | 12/1992 | Thwing | |
| 5,394,711 | A * | 3/1995 | Pitkanen | E05B 9/086 70/368 |
| 5,572,890 | A * | 11/1996 | Carpenter | E05B 15/1614 70/371 |
| 6,305,870 | B1 | 10/2001 | Mita et al. | |
| 6,644,076 | B2 | 11/2003 | Huang | |

(Continued)

FOREIGN PATENT DOCUMENTS

JP 2004-285706 A 10/2004

OTHER PUBLICATIONS

International Search Report; Apr. 30, 2015.

*Primary Examiner* — Christopher Boswell

(74) *Attorney, Agent, or Firm* — Barnes & Thornburg LLP

(57) ABSTRACT

A padlock with a removable lock cylinder. A retaining member couples the lock cylinder to the padlock's body. In some embodiments, the retaining member includes a flange for actuating the retaining member between a retained position and a released position. The flange is accessible through an opening of the lock body when the shackle is in the unlocked position and inaccessible when the shackle is in the locked position.

6 Claims, 8 Drawing Sheets

(56) References Cited

U.S. PATENT DOCUMENTS

| | | | |
|---|---|---|---|
| 6,901,638 | B2 | 6/2005 | Itou et al. |
| 7,051,562 | B2 | 5/2006 | Evans |
| 7,234,331 | B2 | 6/2007 | Armstrong et al. |
| 2002/0007654 | A1 | 1/2002 | Watts |
| 2003/0196461 | A1* | 10/2003 | Liou ..... E05B 11/00 70/38 A |
| 2006/0185404 | A1 | 8/2006 | Hansen |
| 2011/0041577 | A1 | 2/2011 | Zhang |
| 2011/0041579 | A1 | 2/2011 | Chen |
| 2011/0094273 | A1 | 4/2011 | Uliano |

* cited by examiner

PADLOCK CYLINDER RETENTION

RELATED APPLICATION

The present application is related to and claims priority to U.S. Provisional Patent Application Ser. No. 61/928,483, filed on Jan. 17, 2014, entitled "Padlock Cylinder Retention." The subject matter disclosed in that provisional application is hereby expressly incorporated into the present application in its entirety.

TECHNICAL FIELD

The present disclosure relates to padlocks. More particularly, the present disclosure relates to padlocks that employ a retaining member to hold a lock cylinder in place and that retaining member may be accessed without disassembling the padlock body.

BACKGROUND AND SUMMARY

Padlocks are portable locks that typically include a shackle movable between a locked position in which the shackle is retained within the padlock and an unlocked in which at least one arm of the shackle is released from the padlock. Certain padlocks include lock cylinders that can be actuated with an authorized key to unlock the shackle. In some situations, the lock cylinder needs to be removed, such as for security reasons to change the key, maintenance and/or repair. The change and/or repair of a lock cylinder has often required the disassembly of padlock components, which is a tedious and difficult task that typically would need to be performed by a locksmith. There have been attempts to develop a padlock with a removable cylinder, such as described in U.S. Pat. No. 3,750,432 for a Padlock with Laminated Body and Removable Cylinder. However, this padlock has a complex retaining device that requires a bolt to be unscrewed to move a locking plate that is used to detach the lock cylinder. There is a need for a novel retaining device that allows a lock cylinder to be removed from a padlock.

An illustrative embodiment of a padlock of the present disclosure includes a shackle, body, and lock cylinder. To hold the lock cylinder in place, the present disclosure employs a retaining member fitted within the body holding the lock cylinder to the body. The retaining member is accessible and movable within a shackle-receiving opening in the body. This means when the padlock is locked and the shackle is located in the opening, the retaining member holding the lock cylinder is inaccessible. In contrast, when the padlock is unlocked and an arm of the shackle is removed from the opening, the retaining member is accessible. In such circumstance, the retaining member may be moved to selectively engage or disengage the lock cylinder to hold or release the lock cylinder to or from the padlock. This translates into fewer parts being employed in the lock to retain the lock cylinder. In an illustrative embodiment, holes or other grip structures in the retaining member may be employed to slide the retaining member to hold or release the lock cylinder.

According to one aspect, this disclosure provides a padlock with a body, a shackle, a lock cylinder with the lock body and a retaining member. The shackle is movable relative to the body between a locked position and an unlocked position. The shackle includes a first arm movably installed within a first opening of the lock body and a second arm retained within a second opening of the lock body in the locked position. The second arm is movable out of the second opening of the lock body in the unlocked position. The retaining member is movable between a first position that couples the lock cylinder with the body and a second position that releases the lock cylinder from the body. The retaining member includes a flange for actuating the retaining member between the first position and the second position. The flange is accessible through the second opening of the lock body when the shackle is in the unlocked position and the flange is inaccessible when the shackle is in the locked position.

In one embodiment, the retaining member is movable between the first position and the second position about an axis transverse to a longitudinal axis of the lock cylinder. For example, the retaining member could be slidable between the first position and the second position. Typically, the retaining member forms an interference fit between the body and the lock cylinder in the first position. In some cases, the lock cylinder defines at least one groove and the retaining member includes a portion projecting into the groove to form an interference fit between the lock cylinder and the body when the retaining member is in the first position and out of the groove when the retaining member in the second position.

Embodiments are contemplated in which the retaining member includes a first leg and a second leg extending from the flange. The first leg and the second leg engage the lock cylinder when the retaining member is in the first position. In some cases, the retaining member is configured to wrap the first leg and second leg around at least a portion of the lock cylinder when the retaining member is in the first position. Depending on the circumstances, the first leg and the second leg could be formed to define a U-shape. In some embodiments, the lock cylinder defines a first groove and a second groove. The first groove is spaced apart from the second groove. The first leg is received in the first groove and the second leg is received in the second groove when the retaining member is in the first position.

In some embodiments, the first leg and/or the second leg may include a laterally extending bump. In some cases, the body defines a slot that extends transverse to a longitudinal axis of the lock cylinder and the retaining member is movable between the first position and the second position within the slot. In some embodiments, the slot includes at least one recess configured to receive the bump when the retaining member is in the first position. Depending on the circumstances, the flange may include one or more recesses for gripping the retaining member.

According to a further aspect, the disclosure provides a padlock with a body, a shackle, a lock cylinder and a retaining clip. The shackle is movable relative to the body between a locked position and an unlocked position. The shackle includes a first arm movably installed within a first opening of the lock body and a second arm retained within a second opening of the lock body in the locked position. The second arm is movable out of the second opening of the lock body in the unlocked position. The retaining clip includes a first leg and a second leg extending from a flange. The retaining clip is slidable between a first position in which the first leg and the second leg engage the lock cylinder to couple the lock cylinder to the body and a second position that releases the lock cylinder from the body.

In some embodiments, the retaining clip is accessible through the second opening of the lock body when the shackle is in the unlocked position, but inaccessible when the shackle is in the locked position. In some cases, the first leg and second leg of the retaining member is configured to wrap around at least a portion of the lock cylinder when the retaining member is in the first position. Depending on the circumstances, the first leg and the second leg could define a U-shape. In some embodiments, the lock cylinder defines a first groove and a second groove, which are spaced apart. The first leg is received in the first groove and the second leg is received in the second groove when the retaining member is in the first position. In some cases, the first leg and the second leg include a laterally extending bump. For example, the body could define a slot with at least one recess configured to receive the bump when the retaining member is in the first position.

According to yet another aspect, this disclosure provides a method of removing a lock cylinder from a padlock. The method includes the step of providing a padlock including a body, a lock cylinder, a retaining member coupling the lock cylinder to the body, and a shackle movable relative to the body between a locked position and an unlocked position. The shackle includes a first arm movably installed within a first opening of the lock body and a second arm retained within a second opening of the lock body in the locked position. The second arm is movable out of the second opening of the lock body in the unlocked position. The next step is unlocking the padlock and moving the second arm away from the second opening to expose the retaining member in the second opening. The lock cylinder can then be released from the body by sliding the retaining member away from the lock cylinder. The lock cylinder can now be removed from the body.

Additional features and advantages of the padlock will become apparent to those skilled in the art upon consideration of the following detailed description of the illustrated embodiment exemplifying the best mode of carrying out the padlock as presently perceived.

BRIEF DESCRIPTION OF DRAWINGS

The present disclosure will be described hereafter with reference to the attached drawings which are given as non-limiting examples only, in which.

Corresponding reference characters indicate corresponding parts throughout the several views. The exemplification set out herein illustrates embodiments of the padlock, and such exemplification is not to be construed as limiting the scope of the padlock in any manner.

DETAILED DESCRIPTION OF THE DRAWINGS

Figure 1:
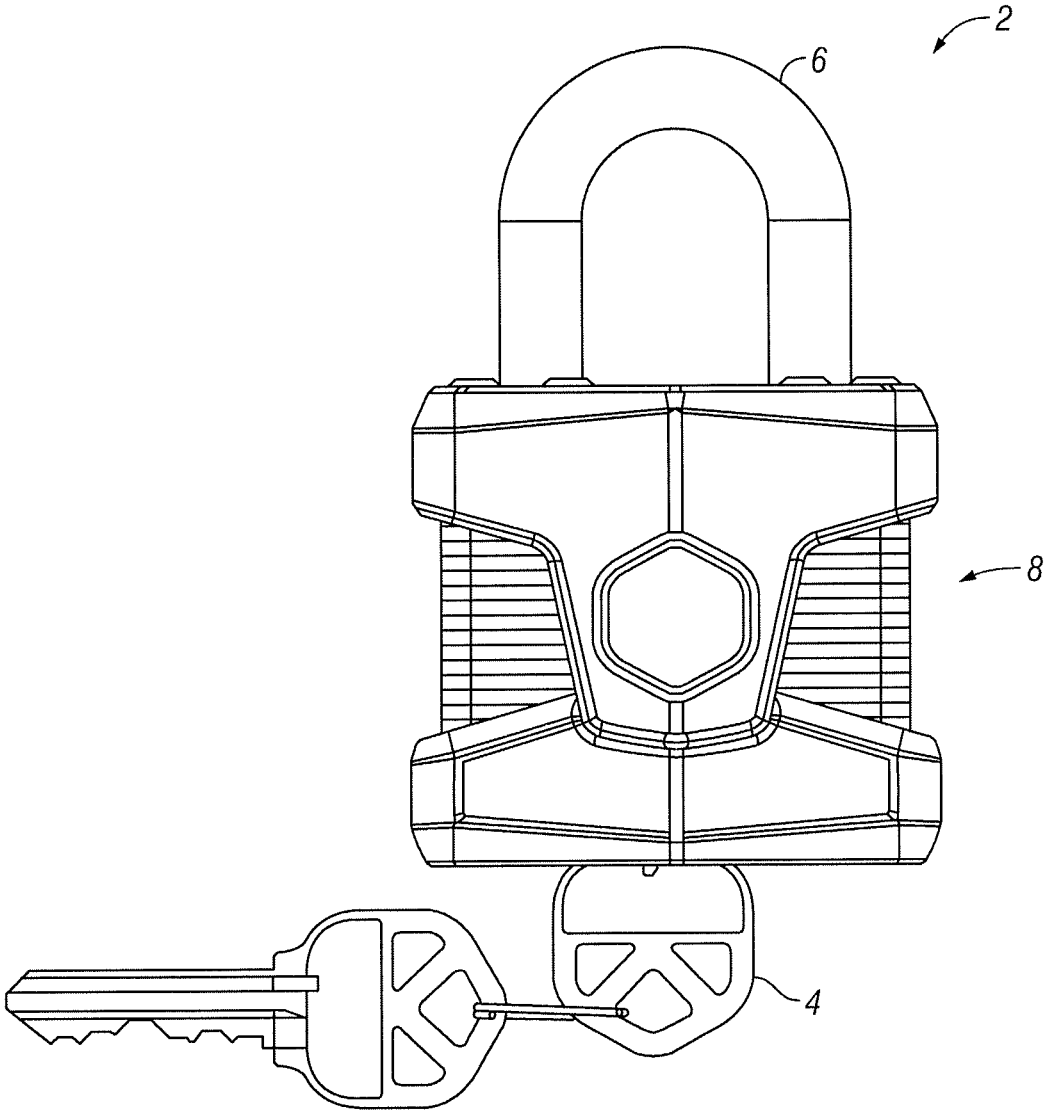
FIG. 1 is a front view of an illustrative embodiment of a padlock according to the present disclosure.

A front view of padlock 2 with an illustrative key 4 inserted therein is shown in FIG. 1. This view also shows shackle 6 in its locked position within body 8.

Figure 2:
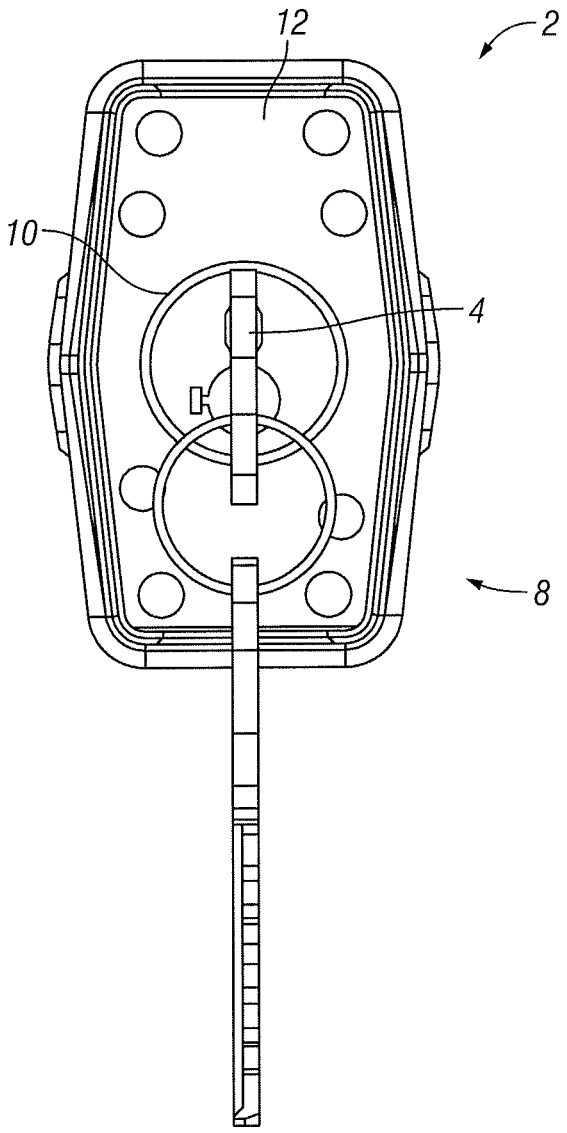
FIG. 2 is an end view of the padlock of FIG. 1.

An end view of padlock 2 with key 4 extending therein is shown in FIG. 2. This view shows key 4 extended into lock cylinder 10 which operates the locking and unlocking features of padlock 2. Lock cylinder 10 inserts into laminate portion 12 and into body 8 of padlock 2. Occasionally, cylinder 10 may need to be removed in order to change, clean, or modify it. By nature of a padlock, however, this can be a relatively difficult task that employs a number of parts and a substantial disassembly process. An illustrative embodiment of this padlock, to the contrary, makes removing the cylinder relatively easy, not requiring removal of any components. At the same time, removing lock cylinder 10 may only be accomplished when shackle 6 is in an unlocked condition. In the present disclosure, a retaining member, as described further herein, is located in the body 8 and is movable to secure to or release from the lock cylinder. When the retaining member releases lock cylinder 10, it may be removed. Conversely, when the retaining member couples to lock cylinder 10, it is not removable. Access to the retaining member to move it in order to hold or release lock cylinder 10 is accomplished through a cavity that receives a portion of shackle 6. This makes accessing the retaining member only possible when padlock 2 is unlocked. The member may be slid back and forth inside the opening to lock or release lock cylinder 10.

Figure 3:
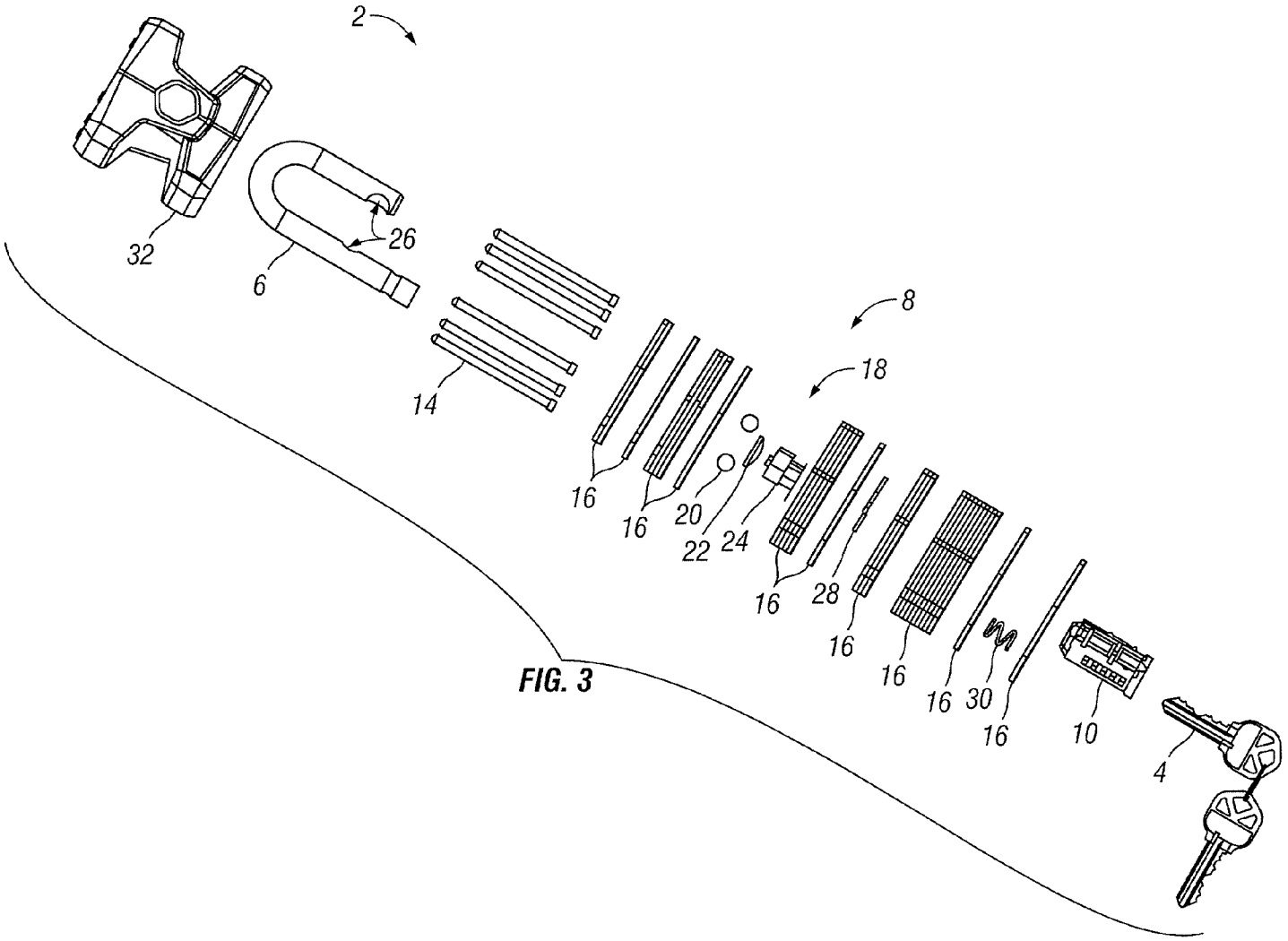
FIG. 3 is an exploded perspective view of the padlock of FIG. 1.

An exploded view in FIG. 3 shows the components of padlock 2. A plurality of rivet pins 14 extend through openings in a plurality of laminates 16 forming body 8. It is appreciated that most of the laminates appearing similar from the sides have different openings in them to accommodate structures such as shackle 6, lock cylinder 10, and other structures as further defined herein. In addition to lock cylinder 10, a lock mechanism 18 includes bearings 20, spiral spring 22, and bearing ball cam 24. Lock mechanism 18 is configured so bearings 20 engage recesses 26 in shackle 6. In this illustrative embodiment, lock mechanism 18 may operate via any manner known to lock or release a padlock shackle. In addition, lock cylinder 10 may be configured in any known manner to effectuate lock mechanism 18.

Retaining member 28 is shown sandwiched between several of laminates 16. Further components include a spring 30 fitted to bias against shackle 6, and lock cylinder 10 fitted into laminate 16 and secured to body 8 by retaining member 28. Lock cylinder 10 also engages bearing ball cam 24 to secure or release shackle 6 when activated by key 4. In this illustrative embodiment, a jacket 32 may optionally be employed to fit over the laminates that form body 8.

Figure 4:
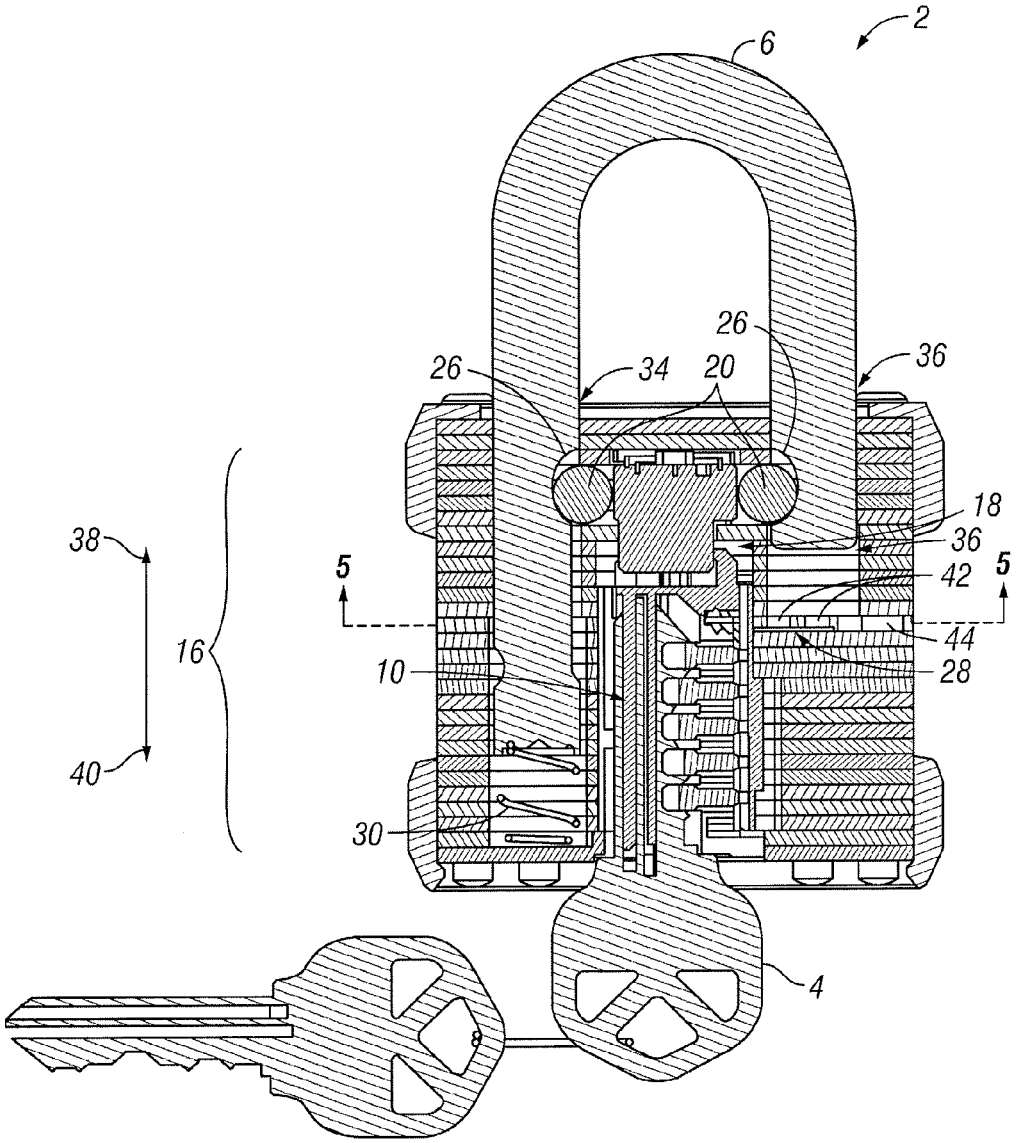
FIG. 4 is a front cross-sectional view of the padlock of FIG. 1 taken along lines 4-4 of FIG. 5.

A side cross-sectional view of padlock 2 is shown in FIG. 4. This view shows the assembly of the structures described from FIG. 3 to form padlock 2. As shown, shackle 6 fits into cavities 34 and 36, and engage bearings 20 in recesses 26. Spring 30 located in cavity 34 biases shackle 6 in direction 38 so that when key 4 is inserted into lock cylinder 10 causing lock mechanism 18 to make bearings 20 to disengage from shackle 6, shackle 6 will push upward in direction 38. As this happens, a portion of shackle 6 exits cavity 36 exposing the same. Retaining member 28 is shown located illustratively at the bottom of cavity 36. Illustrative recesses 42 in retaining member 28 provide gripping or engaging surfaces to allow a tool to move retaining member 28 in a slot 44 formed in laminates 16. When shackle 6 is moved in direction 40 locking padlock 2, as shown in this FIG. 1, there is no external access to retaining member 28. This means retaining member 28 may not be clandestinely exploited to release lock cylinder 10 to bypass the security of padlock 2.

Figure 5:
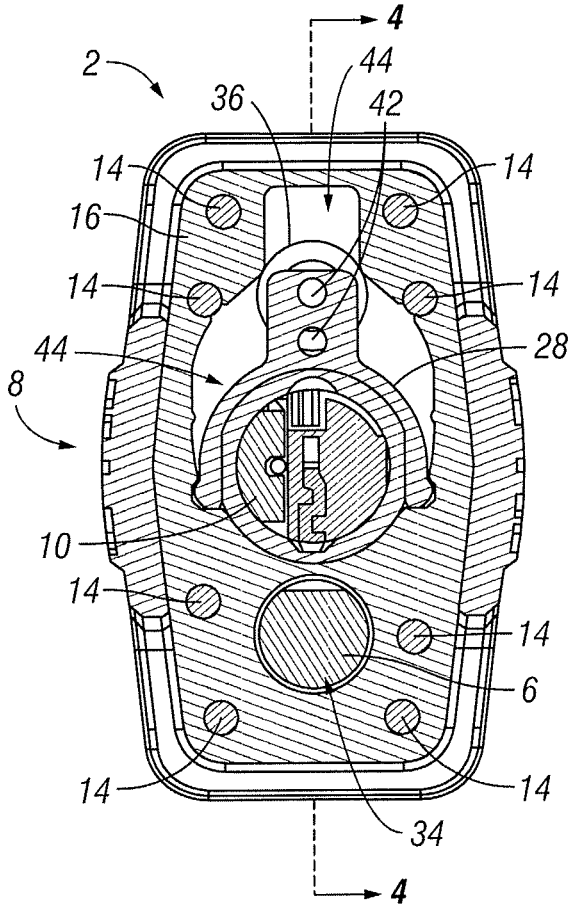
FIG. 5 is an end cross-sectional view of the padlock of FIG. 1 taken along the lines 5-5 of FIG. 4.

An end cross-sectional view of padlock 2 is shown in FIG. 5. This view shows how slot 44 may be formed in laminate 16 and sized to allow retaining member 28 to move between its secured position holding lock cylinder 10 in place and a release position that allows lock cylinder 10 to be removed. This view also shows how retaining member 28 may illustratively be horseshoe-shaped to clip around lock cylinder 10. It is appreciated, however, that the shape of retaining member 28 may have a different geometry that can still hold lock cylinder 10. Recesses 42 providing an engagement surface is also shown in this view. Because this view shows retaining member 28 being essentially in the middle of the laminates 16 (i.e., middle of padlock 2), it cannot be accessed exterior of padlock 2 without shackle 6 being unlocked. Cavity 36 is not accessible when shackle 6 is in the locked position. Thus, there is no access to retaining member 28.

Figure 6:
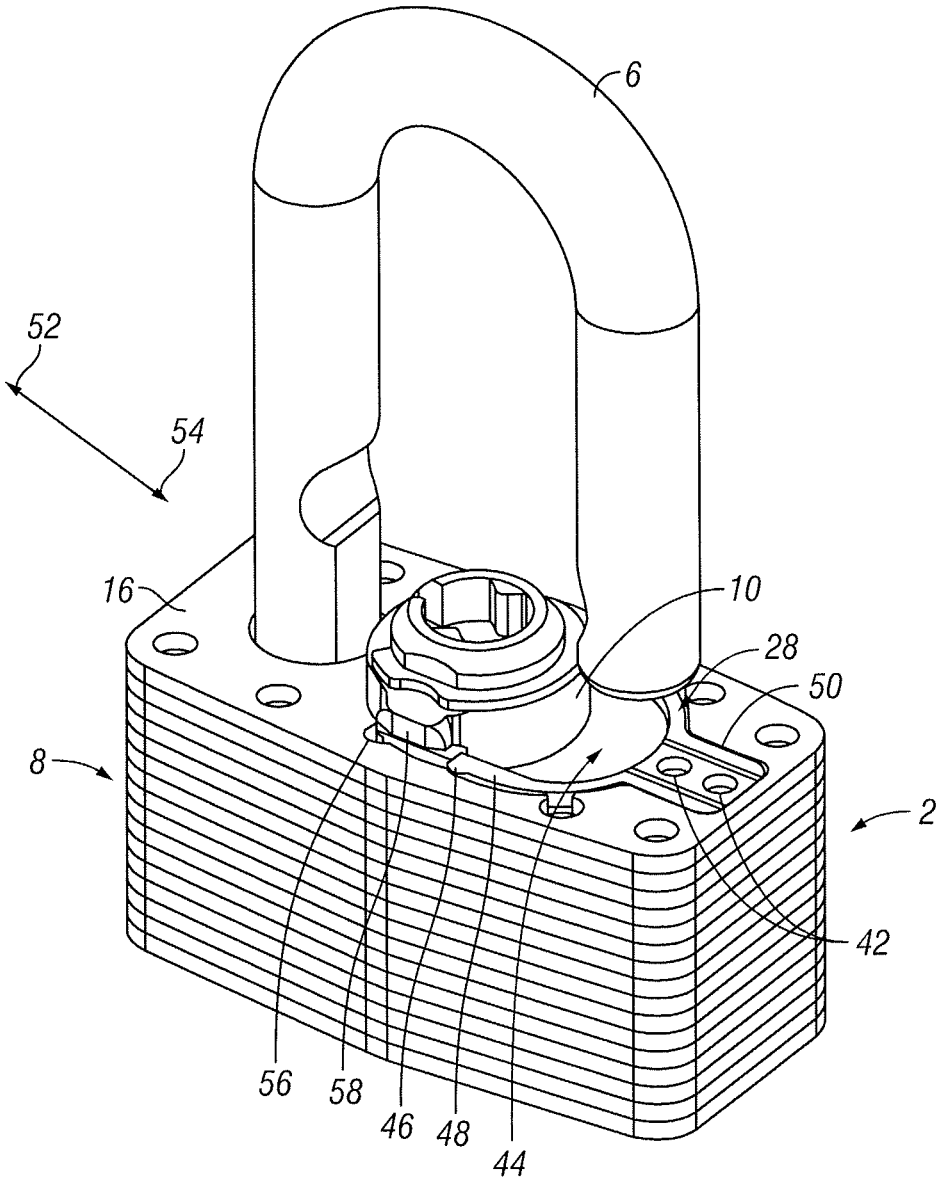
FIG. 6 is a perspective detail view of a portion of the padlock of FIG. 1.

A perspective detail view of a portion of padlock 2 is shown in FIG. 6. This view shows retaining member 28 being disengaged from lock cylinder 10 and in slot 44. This view also better shows the horseshoe-shape of retaining member 28 including retention bumps 46 that extend laterally from legs 48 of retaining member 28. Further, flange portion 50 has recesses 42 which are accessible by inserting a tool in cavity 36 (not shown in this view) and sliding in directions 52 and 54. This particular view shows retaining member 28 slid in direction 54 releasing it from lock cylinder 10. Slot receivers 56 are formed in slot 44 and configured to receive retention bumps 46 to hold retention member 28 in place when securing to lock cylinder 10.

Figure 7:
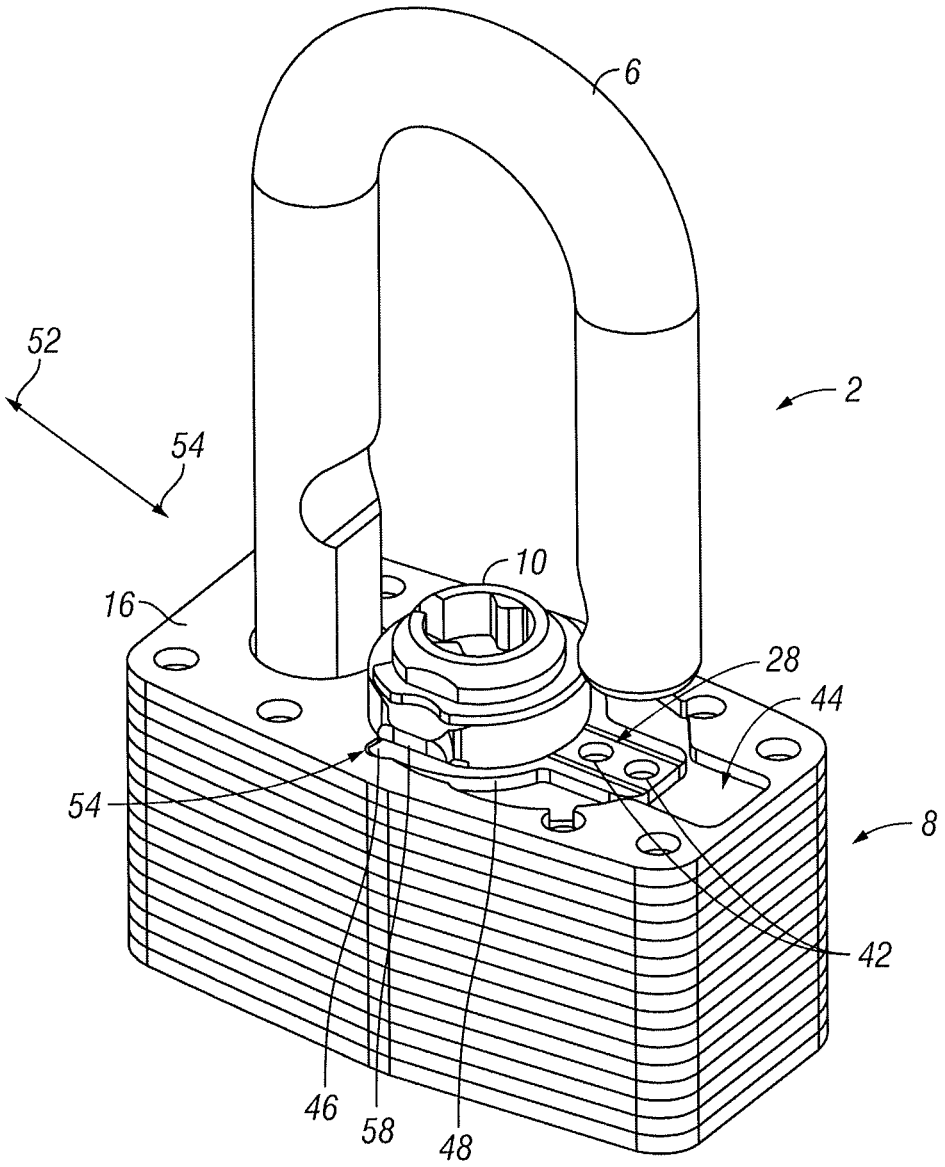
FIG. 7 is another detailed view of a portion of the padlock of FIG. 1.

Another detailed perspective view of a portion of padlock 2 is shown in FIG. 7. This view is similar to that shown in FIG. 6, except in this case, retaining member 28 has been moved in direction 52 to secure onto lock cylinder 10 holding the same in place. Because retaining member 28 sits in slot 44 which is sandwiched between laminate 16 to form body 8, cylinder 10 cannot move in directions 38 or 40 (see FIG. 4) to be removed from padlock 2. This figure demonstrates how legs 48 illustratively wrap around a portion of lock cylinder 10 to help hold the same in place. Also retention bumps 46 are shown fitted in slot recesses 56 to further assist holding retaining member 28 in place so when reinserting the cylinder the retaining member 28 will not interfere. In this illustrative embodiment, tabs 58 on lock cylinder 10 extend therefrom. Legs 48 of retaining member 28 are configured to fit underneath tabs 58 to block lock cylinder 10 from moving. In other words, legs 48 sandwiched between tabs 58 and laminates 16 prevent lock cylinder 10 from being removed from padlock 2. This view contrasts from FIG. 6 where legs 48 are cleared from tabs 58 which then allows lock cylinder 10 to be removed.

Figure 8:
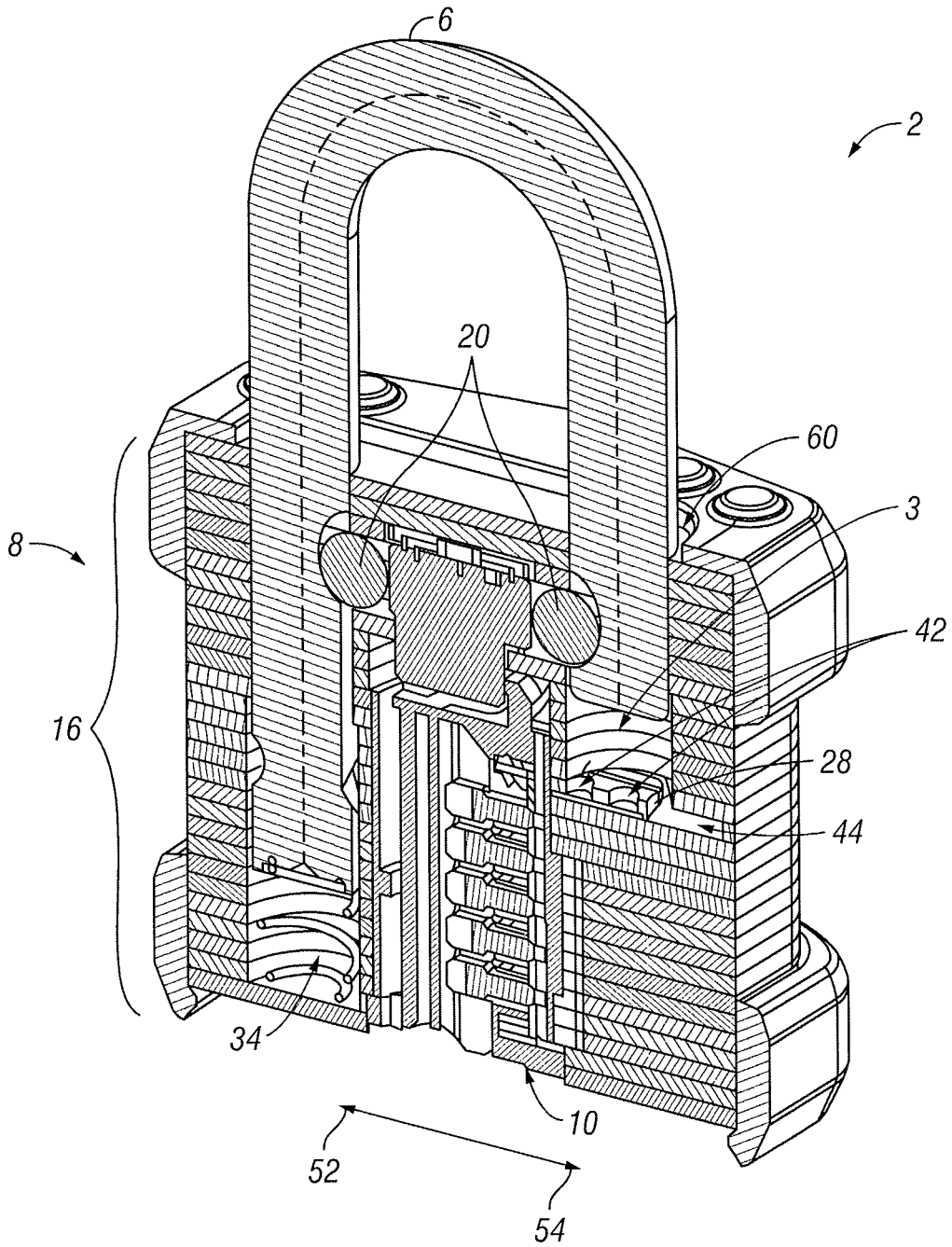
FIG. 8 is a perspective cross-sectional view of the padlock of FIG. 1.

A perspective cross-sectional view of padlock 2 is shown in FIG. 8. This view not only demonstrates the positioning of the structures of padlock 2, as previously discussed, but also shows how retaining member 28 is accessible in cavity 36 when shackle 6 is in the unlocked position. As shown, cavity 36 extends up to an opening 60 that is only accessible when a portion of shackle 6 is not extended in cavity 36. In this unlocked condition, a tool or other device may be inserted in opening 60 through cavity 36 to access recesses 50 or other like structures to slide retaining member 28 in directions 52 or 54. Notice that because laminates 16 essentially surround retaining member 28, except for cavity 36, there is no other way to access and move retaining member 28.

Although the present disclosure has been described with reference to particular means, materials and embodiments, from the foregoing description, one skilled in the art can easily ascertain the essential characteristics of the present disclosure and various changes and modifications may be made to adapt the various uses and characteristics without departing from the spirit and scope of the present invention.

What is claimed:

1. A padlock comprising:

a body;

a shackle movable relative to the body between a locked position and an unlocked position, wherein the shackle includes a first arm movably installed within a first opening of the lock body, wherein the shackle includes a second arm retained within a second opening of the lock body in the locked position and movable out of the second opening of the lock body in the unlocked position;

a lock cylinder within the lock body;

a retaining member movable between a first position that couples the lock cylinder with the body and a second position that releases the lock cylinder from the body;

wherein the retaining member includes a flange for actuating the retaining member between the first position and the second position, wherein the flange is accessible through the second opening of the lock body when the shackle is in the unlocked position and the flange is inaccessible when the shackle is in the locked position;

wherein the retaining member is movable between the first position and the second position about an axis transverse to a longitudinal axis of the lock cylinder;

wherein the retaining member includes a first leg and a second leg extending from the flange;

wherein the first leg and the second leg engage the lock cylinder when the retaining member is in the first position; and wherein at least one of the first leg and second leg include a laterally extending bump.

2. The padlock as recited in claim 1, wherein the body defines a slot that extends transverse to a longitudinal axis of the lock cylinder, wherein the retaining member is movable between the first position and the second position within the slot.

3. The padlock as recited in claim 2, wherein the slot includes at least one recess configured to receive the bump when the retaining member is in the first position.

4. The padlock as recited in claim 3, wherein the flange includes one or more recesses for gripping the retaining member.

5. A padlock comprising:

a body;

a shackle movable relative to the body between a locked position and an unlocked position, wherein the shackle includes a first arm movably installed within a first opening of the lock body, wherein the shackle includes a second arm retained within a second opening of the lock body in the locked position and movable out of the second opening of the lock body in the unlocked position;

a lock cylinder within the lock body;

a retaining clip comprising a first leg and a second leg extending from a flange, wherein the retaining clip is slidable between a first position in which the first leg and the second leg engage the lock cylinder to couple the lock cylinder to the body and a second position that releases the lock cylinder from the body;

wherein the flange of the retaining clip is accessible through the second opening of the lock body when the shackle is in the unlocked position and the flange is inaccessible when the shackle is in the locked position; and wherein the first leg and the second leg include a laterally extending bump.

6. The padlock as recited in claim 5, wherein the body defines a slot that extends transverse to a longitudinal axis of the lock cylinder, wherein the retaining member is movable between the first position and the second position within the slot, wherein the slot includes at least one recess configured to receive the bump when the retaining member is in the first position.

* * * * *